US005316654A

United States Patent [19]

Berkebile, deceased et al.

[11] Patent Number: 5,316,654

[45] Date of Patent: May 31, 1994

[54] PROCESSES FOR THE MANUFACTURE OF ENRICHED PITCHES AND CARBON FIBERS

[76] Inventors: Donald C. Berkebile, deceased, late of Ashland, Ky.; Catherine Berkebile, Administratrix, 324 Squires Rd., Lexington, Ky. 40515; Donald M. Lee, 92 S. Altamont Rd., Huntington, W. Va. 25701; Larry D. Veneziano, 2690 Velma Ct., Simi, Calif. 93065; Joseph J. Lauer, 421 Bellefonte Princess, Ashland, Ky. 41101; Roy E. Booth, P.O. Box 630003, Dallas, Tex. 75265; William P. Hettinger, 203 Meadowlark Rd., Russell, Ky. 41101; Willard Jones, 1931 B Pinehurst Ct., Allentown, Pa. 18103

[21] Appl. No.: 776,179

[22] Filed: Sep. 13, 1985

[51] Int. Cl.[5] ..... C10C 1/00

[52] U.S. Cl. ..... 208/39; 208/22; 208/41; 208/44; 423/447.1; 423/447.6

[58] Field of Search ..... 208/22, 39, 41, ; 423/447.1, 447.6

[56] References Cited

U.S. PATENT DOCUMENTS

| | | | |
|---|---|---|---|
| 1,404,435 | 1/1922 | Geversorban | 208/6 |
| 3,348,600 | 10/1967 | Monty | 159/13.1 |
| 3,349,828 | 10/1967 | Monty | 264/210 F |
| 3,615,995 | 10/1971 | Buntin et al. | 156/180 |
| 3,684,415 | 10/1971 | Buntin et al. | 156/180 |
| 3,755,527 | 8/1973 | Keller et al. | 264/176 F |
| 3,825,380 | 7/1974 | Harding et al. | 156/167 |
| 3,849,241 | 7/1974 | Buntin et al. | 156/180 |
| 3,919,376 | 11/1975 | Schulz | 264/102 |
| 3,967,729 | 8/1976 | Lewis et al. | 423/447.6 |
| 3,967,729 | 7/1976 | Tanner, II | 206/440 |
| 4,005,183 | 1/9177 | Singer | 423/447.2 |
| 4,014,725 | 3/1977 | Schulz | 156/167 |
| 4,042,486 | 8/1977 | Asano et al. | 208/39 |
| 4,243,512 | 1/1981 | Seo | 208/22 |
| 4,427,530 | 1/1984 | Dickakian | 208/22 |
| 4,448,670 | 5/1984 | Dickakian | 208/22 |
| 4,469,667 | 9/1984 | Uemura et al. | 208/22 |
| 4,497,789 | 2/1985 | Sauran et al. | 208/22 |
| 4,528,087 | 7/1985 | Shibatani et al. | 208/22 |
| 4,575,411 | 3/1986 | Uemura et al. | 423/447.1 |
| 4,597,853 | 7/1986 | Moriya | 208/22 |

FOREIGN PATENT DOCUMENTS

| | | | |
|---|---|---|---|
| 0084237 | 7/1983 | European Pat. Off. | 208/22 |
| 0151223 | 8/1985 | European Pat. Off. . | |
| 101191 | 6/1983 | Japan . | |
| 2156378 | of 0000 | United Kingdom . | |
| 2109001 | 5/1983 | United Kingdom | C10C 3/06 |

OTHER PUBLICATIONS

"Case History-Slytherm ®800 Heat Transfer Liquid", Dow Corning, Form #24-152-85 (Waltham, Mass.)

(List continued on next page.)

*Primary Examiner*—Helane Myers

*Attorney, Agent, or Firm*—Richard C. Willson, Jr.; Stanley M. Welsh; James L. Wilson

[57] ABSTRACT

There are provided improved processes for the manufacture of enriched pitches, carbon fiber precursors, carbon fibers, and graphite fibers. The improvement comprises employing an elevated wiped-film evaporator in a wiped-film evaporator system comprising the wiped-film evaporator and a means for recovering enriched pitch, such as a positive displacement pump, to form an enriched pitch from catalytic pitch and regulating the operating conditions of the wiped-film evaporator system to provide the desired enriched pitch. The wiped-film evaporator is located a specific distance above the means for recovering enriched pitch. The vertical distance between the outlet of the wiped-film evaporator and the inlet of the means for recovering enriched pitch is within the range of about 10 feet to about 40 feet, preferably about 20 feet to about 40 feet.

29 Claims, 2 Drawing Sheets

OTHER PUBLICATIONS

"Information About Syltherm® 800 Heat Transfer Liquid", Dow Corning, 1984 & 1985.

"Syltherm® 800 Heat Transfer Liquid", Dow Corning, Aug. 1983 Chemical Processing.

"A Design Guide for Syltherm® 800 Heat Transfer Liquid", Dow Corning, 1984.

Case History-"Syltherm® 800 Heat Transfer Liquid", Dow Corning, 1985, Form #24-153-85 (Buffalo, N.Y.).

Case History-"Syltherm® 800 Heat Transfer Liquid" Dow Corning, 1985, Form #24-296-85 (Oildale, Calif.).

"A Guide to Specifying Syltherm® 800 Heat Transfer Liquid" Dow Corning, Form #24-183-85, 1985.

"A Design Guide for Syltherm® 800 Heat Transfer Liquid", Dow Corning, 1985.

"Syltherm® 800 Heat Transfer System Design Checklist", Dow Corning, Version 2.2.

Syltherm 800 Heat Transfer Liquid-Dow Corning.

PROCESSES FOR THE MANUFACTURE OF ENRICHED PITCHES AND CARBON FIBERS

BACKGROUND OF THE INVENTION

Petroleum pitches are recognized as suitable sources of carbon and, if having the proper softening point, can be used satisfactorily as an impregnation material for electrodes, anodes, and carbon-carbon composites, e.g., carbon-carbon fiber composites, such as aircraft brakes and rocket engine nozzles. The pitches can be used in the nuclear industry for the preparation of fuel sticks for a graphite moderated reactor. Furthermore, such pitches can be used in the production of carbon fiber precursors, carbon fibers, and graphite fibers.

Carbon and graphite fibers provide a high strength per weight ratio. Such property enables them and composites made from them to be used in sporting equipment, automobile parts, light-weight aircraft, and increasing aerospace applications.

While various different carbonaceous materials (sometimes called fiber precursors) have been disclosed in the prior art for the manufacture of carbon or graphite fibers, two significant commercial processes employ polyacrylonitrile or mesophase pitch to produce high-strength graphite fibers. However, such processes have disadvantages. For example, the preparation of mesophase pitch requires that the initial feedstock be heated to an elevated temperature for a number of hours, as shown by Lewis, et al., in U.S. Pat. No. 3,967,729, by Singer, in U.S. Pat. No. 4,005,183, and by Schulz, in U.S. Pat. No. 4,014,725. Therefore, such a process is time consuming and costly. In addition, care must be taken in heating for a specific time, since mesophase pitch can increase in viscosity rapidly, making it unsuitable for spinning. On the other hand, polyacrylonitrile is a relatively expensive feedstock, equalizing the overall cost of producing fibers from polyacrylonitrile with the cost of producing carbon or graphite fibers from mesophase pitch.

Recently, Sawran, et al., in U.S. Pat. No. 4,497,789, have disclosed a process for producing substantially non-mesophasic pitch and a method for producing carbon fibers therefrom. The disclosure of this patent is expressly incorporated by reference herein and made a part hereof.

Now an improved process for the manufacture of pitches having relatively high softening points has been developed. In addition, an improved process for making carbon fiber precursors, as well as carbon fibers, has been developed. In these improved processes, an elevated wiped-film evaporator is employed.

SUMMARY OF THE INVENTION

Broadly, there is provided an improved process for the production of an enriched pitch from a catalytic pitch, which process comprises treating a petroleum pitch derived from a highly aromatic slurry oil in a wiped-film evaporator system comprising a wiped-film evaporator and a means for recovering an enriched pitch to prepare an enriched pitch having a higher softening point, the outlet of said wiped-film evaporator being connected to the inlet of said means for recovering enriched pitch and being located at a point above said inlet of said means for recovering enriched pitch so that the vertical distance between said outlet of said wiped-film evaporator and said inlet of said means for recovering enriched pitch is within the range of about 10 feet to about 40 feet and the wiped-film evaporator system being maintained at operating conditions that will provide said enriched pitch.

There is provided an improved process for the production of carbon fiber precursors, which process comprises treating a catalytic pitch in a wiped-film evaporator system comprising a wiped-film evaporator and a means for recovering enriched pitch to form an enriched pitch, the outlet of said wiped-film evaporator being located above the inlet of said means for recovering enriched pitch and being connected to said inlet of said means for recovering enriched pitch so that the vertical distance between said outlet of said wiped-film evaporator and said inlet of said means for recovering enriched pitch is within the range of about 10 feet to about 40 feet and the wiped-film evaporator system being maintained at operating conditions that will provide said enriched pitch, melting said enriched pitch to form a melted pitch, converting said melted pitch into pitch fibers, and stabilizing said pitch fibers by contacting them with an oxidant for a time of less than 100 minutes at an elevated temperature to form a stabilized product.

Also, carbon fibers or graphite fibers can be produced by carbonizing the stabilized fibers in an inert atmosphere at specific elevated temperatures.

In each of the above processes, the improvement comprises locating the wiped-film evaporator at a point that is above the means for recovering enriched pitch, the outlet of the wiped-film evaporator being located at the above-specified vertical distance above the inlet of the means for recovering enriched pitch, and regulating the operating conditions of the wiped-film evaporator system to provide the enriched pitch.

DESCRIPTION AND PREFERRED EMBODIMENT

Figure 1:
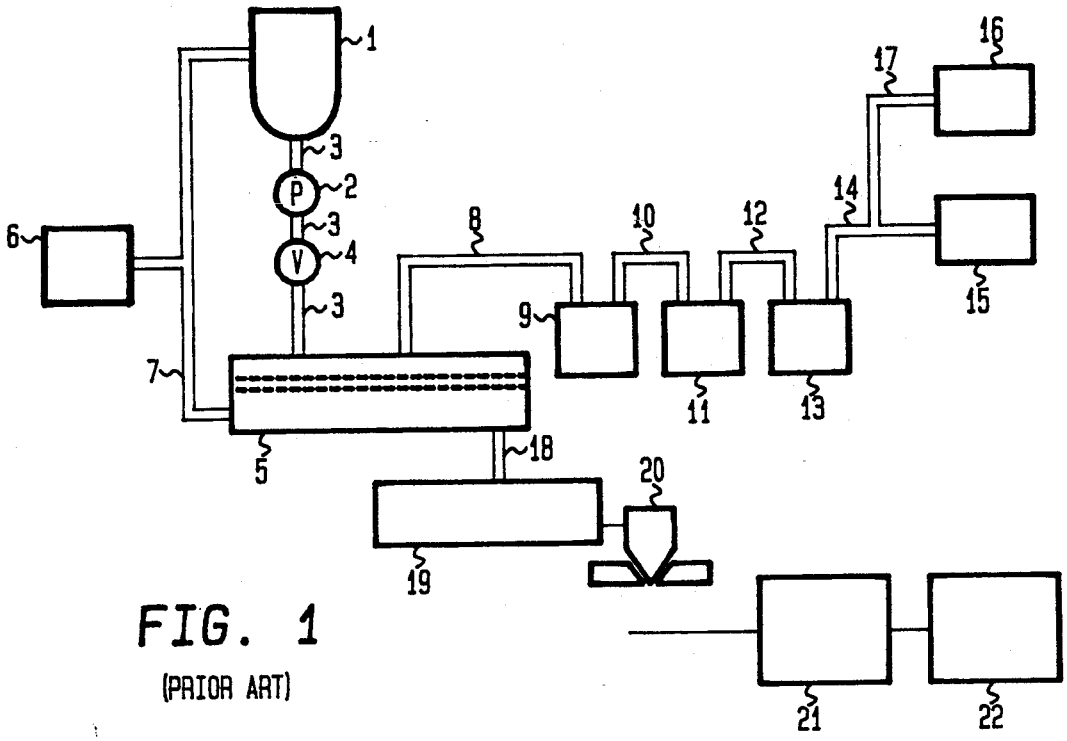
FIG. 1 (PRIOR ART)
FIG. 1 is a schematic diagram of a prior art process for the manufacture of carbon fibers.

The process of the present invention utilizes a high softening point, non-mesophase, quickly stabilizable aromatic enriched pitch material having a normal heptane insolubles content (ASTM D-3279-78) of about 80 wt % to about 90 wt % and the properties set forth in Table I hereinbelow.

TABLE I

Properties of Enriched Pitch Material

| Property | ASTM Number | Value |
|---|---|---|
| Softening Point, °C. | D-3104 | At least 249 |
| Xylene Insolubles, wt % | D-3671 | 15-40 |
| Coking Value, wt % | D-2416 | 65-90 |
| Helium Density, gm/cc | (1) | At about 1.25-1.32 |
| Sulfur, wt % | D-1552 | 0.1-4.0 |

(1) Determined by Beckman Pycnometer, gm/cc @ 25° C.

The aromatic enriched pitch material, also referred to as "fiber precursor pitch", can be prepared from a pitch material which may be an unoxidized, highly-aromatic, high-boiling fraction obtained from the distillation of crude oils or preferably from the pyrolysis of heavy aromatic slurry oil from the catalytic cracking of petroleum distillates. Such original pitch material is often referred to as "catalytic pitch". The enriched pitch material can be further characterized as an aromatic enriched thermal petroleum pitch.

The catalytic pitches that can be utilized in the process of the present invention can be characterized by a combination of their chemical composition and certain physical and/or chemical properties. Parameters for such characterization are presented hereinbelow in Table II.

TABLE II

Characterization Parameters for Catalytic Pitch

| Property | Operable Range | Preferred Range |
|---|---|---|
| Softening Point, °C. | about 40–130 | about 100–130 |
| Xylene insolubles, wt % | < about 8 | < about 5 |
| Quinoline insolubles, wt % | nil | nil |
| Coking value, wt % | < about 48 | < about 51 |
| Carbon/hydrogen atomic ratio | > about 1.2 | > about 1.3 |
| Mesophase content, % | < about 5 | < about 3 |
| Glass transition temperature (tg), °C. | > about 35 | > about 85 |
| Ash, wt % | < about 0.1 | < about 0.01 |

Typically, the catalytic pitches utilized in the processes of the present invention are prepared from heavy slurry oil produced in the catalytic cracking of petroleum fractions. Such pitches remain rigid at temperatures closely approaching their melting points. The preferred starting material for preparing the catalytic pitch is a clarified slurry oil or cycle oil from which substantially all paraffins have been removed in a fluid catalytic cracking operation. Highly selective solvents, such as furfural and N-methyl pyrrolidone, can be used to separate paraffins, when necessary. The feed material should be a highly aromatic oil boiling at a temperature in the range of about 315° C. (599° F.) to about 540° C. (1,004° F.). Such oil is thermally cracked at elevated temperatures and pressures for a time sufficient to produce a catalytic pitch with a softening point in the range of about 40° C. (104° F.) to about 130° C. (266° F.). Of course, catalytic pitches can be prepared by other processing methods known to those skilled in the art.

A preferred catalytic pitch is the product supplied by Ashland Oil, Inc., under the designation "A-240". It is a commercially available unoxidized pitch meeting the requirements in Table II. It is described in more detail in Smith, et al., "Characterization and Reproducibility of Petroleum Pitches", (U.S. Dept. Com., N.T.I.S. 1974, Y-1921), which is incorporated herein by reference.

The process of the present invention can convert conveniently a catalytic pitch, such as A-240, to an enriched pitch having a softening point within the range of about 149° C. (300° F.) to about 282° C. (540° F.), and even higher. Advantageously, the process can be used to obtain enriched pitches having softening points within the range of about 149° C. (300° F.) to about 277° C. (530° F.). Enriched pitches having softening points within that range can be used as a carbon impregnation material, while enriched pitches having softening points of at least 232° C. (450° F.), preferably within the range of about 249° C. (480° F.) to about 277° C. (530° F.), can be used as carbon fiber precursors.

For the present invention, the catalytic pitch is converted to the higher softening point aromatic enriched pitch by the removal or elimination of lower molecular weight species. While a number of conventional techniques, such as conventional batch vacuum distillation, can be used, a continuous equilibrium flash distillation is preferred. The use of a very short residence time wiped-film evaporator, such as the type shown by Monty in U.S. Pat. No. 3,348,600 and in U.S. Pat. No. 3,349,828, is an excellent way of converting the pitch to the higher softening point material.

Furthermore, the high softening point pitch is processed into the form of a continuous mat of fibers by the melt blowing process, which is disclosed by Keller, et al., in U.S. Pat. No. 3,755,527, by Harding, et al., in U.S. Pat. No. 3,825,380, and by Buntin, et al., in U.S. Pat. No. 3,849,241. Sawran, et al., in U.S. Pat. No. 4,497,789, disclose the successful modification of the melt blowing process to permit the production of high quality pitch fiber mats.

In this latter patent, which is incorporated herein by reference and made a part hereof, Sawran, et al., disclose a process for producing high quality carbonized or graphitized roving, mat, or continuous filament product, which process includes the following steps:

1. A petroleum pitch is produced from a highly aromatic slurry oil and is subjected to vacuum flash distillation or wiped-film evaporation to prepare an enriched unique pitch having a softening point of preferably at least 249° C. (480° F.), more preferably about 265° C. (509° F.) or above, and most preferably 254° C. (490° F.) to 267° C. (511° F.), by treating an unmodified thermal petroleum pitch having a softening point, as measured by Mettler softening point apparatus per ASTM Method D-3104, of about 77° C. (171° F.) to 122° C. (252° F.).
2. The high softening point aromatic enriched pitch is converted into a roving or mat of pitch fibers, preferably through the use of a melt blowing process.
3. The pitch fiber roving or mat product is stabilized in less than 200 minutes without addition of reactive species to the pitch, more preferably in less than 100 minutes, and most preferably in about 50 to 90 minutes, in an oxidizing atmosphere at a temperature within the range of about 180° C. (356° F.) to 310° C. (590° F.), preferably in a continuous, multi-stage heat treatment apparatus under oxidizing conditions.
4. The stabilized roving or mat is heated to a temperature within the range of about 900° C. (1,652° F.) to 3,000° C. (5,432° F.) in an inert atmosphere in order to carbonize or graphitize the roving, mat, or continuous filament product.

FIG. 1 is a schematic diagram of a preferred apparatus that is employed in the prior art process of Sawran, et al., U.S. Pat. No. 4,497,789, to produce filaments, roving, or mats of a nonmesophase pitch. By nonmesophase pitch is meant less than about 5% by weight of mesophase pitch.

A mesophase pitch is an optically anisotropic material which forms when a catalytic pitch or fiber precursor pitch is maintained at an elevated temperature for a sufficient period of time. An anisotropic material exhibits properties with different values when measured along axes in different directions.

Therefore, a nonmesophase pitch would generally be referred to in the art as an isotropic pitch, i.e., a pitch exhibiting physical properties such as light transmission with the same values when measured along axes in all directions. Such a nonmesophase pitch can be prepared by the use of a wiped-film evaporator, which enables the time of thermal exposure of the product to be reduced. An example of a suitable wiped-film evaporator is a wiped-film evaporator manufactured by Artisan Industries, Inc., of Waltham, Mass., U.S.A., and sold under the trademark Rototherm. It is a straight-sided, mechanically-aided, thin-film processor operating on the turbulent film principle.

Another example of a suitable wiped-film evaporator is one manufactured by The Pfaudler Co., Division of Sybron Corporation, of Rochester, N.Y., U.S.A.

The feed, i.e., the catalytic pitch material, is introduced into the wiped-film evaporator unit and is thrown by centrifugal force against the heated evaporator walls to form a turbulent film between the wall and the tips of the rotor blade. Regardless of the evaporation rate, the turbulent flowing film covers the entire wall. in this operation, the material is exposed to a high temperature for only a few seconds. Information directed to Rototherm wiped-film evaporators is presented by Monty in U.S. Pat. Nos. 3,348,600 and 3,349,828.

In the apparatus of FIG. 1 is employed an Artisan Rototherm wiped-film evaporator having one square foot of evaporating surface with the blades of the rotor being spaced 1/16th inch away from the wall. The evaporator is a horizontal model with a countercurrent flow pattern.

Referring to FIG. 1, a selected pitch material that had been previously filtered to remove contaminates, such as catalyst fines, therefrom is melted in melt tank 1. The melted pitch material is then pumped by Zenith pump 2 through line 3 and back pressure valve 4 into the wiped-film evaporator 5. The wiped-film evaporator 5 is heated by hot oil that is contained in reservoir 6 and is pumped into the wiped-film evaporator through line 7. As the catalytic pitch material is treated in the wiped-film evaporator 5, vapors escape the evaporator 5 through line 8 and are condensed in a first condenser 9 and a second condenser 11 connected by line 10. The vapors then pass through conduit 12 into cold trap 13 and any non-condensable material passes out through line 14. Vacuum is applied to the system from vacuum pump 15. If main vacuum pump 15 fails, auxiliary vacuum pump 16, connected to the system by conduit 17, is provided.

The enriched pitch is removed from the wiped-film evaporator 5 by means of line 18 and is introduced into collection vessel 19, from which it is sent to melt blowing section 20, which contains a heated die. The product coming from melt blowing section 20 is conveyed into a stabilizing zone 21, where it encounters an oxygen-containing atmosphere, such as air. The stabilized pitch product emanating from stabilizing zone 21, whether it be a filament, roving, or mat, is conveyed into carbonizing zone 22, where it is either carbonized or graphitized, depending upon the conditions being employed. Carbonizing zone 22 is maintained under an inert atmosphere. The finished product is then obtained from carbonizing zone 22.

More particularly, the increased softening point pitch is fed to a melt blowing extruder, which is represented in FIG. 1 by melt blowing section 20. A typical melt blowing extruder is represented by the type disclosed by Buntin, et al., in U.S. Pat. No. 3,615,995, and by Buntin, et al., in U.S. Pat. No. 3,684,415. In these patents is described a technique for melt blowing thermoplastic materials wherein a molten fiber-forming thermoplastic polymer resin is extruded through a plurality of orifices of suitable diameter into a moving stream of hot inert gas, which is issued from outlets surrounding or adjacent to the orifices, in order to attenuate the molten material into fibers which form a fiber stream. The hot inert gas stream flows at a linear velocity parallel to and higher than the filaments issuing from the orifices so that the filaments are drawn by the gas stream. The fibers are collected on a receiver in the path of the fiber stream to form a non-woven mat.

Figure 2:
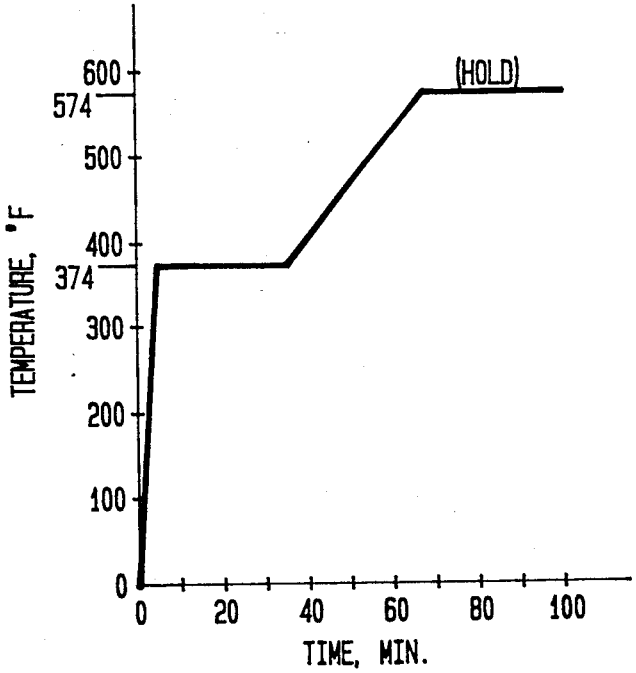
FIG. 2 depicts a stabilization time cycle for treating enriched pitch fibers.

Stabilization of the fibers is then conducted in the stabilizing zone. The fibers are successfully stabilized in air, or other suitable oxygen-containing stream, by a special heat cycle found to be especially suitable. It has been empirically determined that the stabilization cycle that is shown in FIG. 2 can be employed effectively to stabilize the fibers in less than 100 minutes. Such a time is consistent with commercial criteria. More particularly, the 100-minute cycle consists of holding the pitch fibers at approximately 11° C. (20° F.) below the glass transition temperature (tg) of the precursor pitch for about 50 minutes. This is followed by an increase to a temperature of about 200° C. (392° F.) and holding material approximately 30 minutes at that temperature. Then the temperature is increased to a value of about 265° C. (509° F.) and the fibers are held at the latter temperature for 10 minutes. Subsequently the fibers are heated to a temperature of about 305° C. (581° F.) and are held at that temperature for 10 minutes.

An "oxidizing" environment is employed in the stabilization process. By "oxidizing" environment is meant either an oxidizing atmosphere or an oxidizing material impregnated within or on the surface of the fiber being treated. The oxidizing atmosphere can consist of gases such as air, enriched air, oxygen, ozone, nitrogen oxides, and sulfur oxides, and similar materials. Impregnated oxidizing material can be any of a number of oxidizing agents, such as sulfur, nitrogen oxides, sulfur oxides, peroxides, and persulfates.

The fibers are carbonized in carbonizing zone 22. When treated properly, the fibers are carbonized by heating them to a temperature of about 1,100° C. (2,012° F.) to about 1,200° C. (2,192° F.) in an inert atmosphere, such as a nitrogen atmosphere.

It is to be pointed out that air stabilization is much more effective where the fibers are first heated to a temperature of about 6° C. (11° F.) to 11° C. (20° F.) below the glass transition temperature of the pitch precursor and thereafter after a period of time of approximately 50 minutes to a temperature within the range of about 299° C. (570° F.) to about 317° C. (601° F.) until they are stabilized. As used herein, the "glass transition temperature" represents the temperature of Young's Modulus change. It is also the temperature at which a glassy material undergoes a change in coefficient of expansion and it is often associated with a stress release. Thermal mechanical analysis is a suitable analytical technique for measuring tg. The procedure comprises grinding a small portion of pitch fiber and compacting it into a 0.25 inch diameter by 0.125 inch aluminum cup. A conical probe is placed in contact with the surface and a 10-gram load is applied. The penetration of the probe is then measured as a function of temperature as the sample is heated at a rate of 10° C. per minute in a nitrogen atmosphere. At a temperature within the range of about 6° C. (11° F.) to about 11° C. (20° F.) below the glass transition, the fibers maintain their stiffness while at the same time the temperature represents the highest temperature allowable for satisfactory stabilization to occur. This temperature is below the point at which fiber-fiber fusion can occur. After the fiber has been heated at this temperature for a sufficient time to form a skin, the temperature can then be raised at a rate such that the increased temperature is below the glass transition temperature of the oxidized fibers.

It has been discovered that during the oxidation of carbon fibers, the glass transition temperature increases and by maintaining a temperature during heat-up at a point 6° C. (11° F.) to 11° C. (20° F.) below the glass transition temperature, undesired slumping of the fibers does not occur. As the temperature is increased, the oxidation rate increases and, conversely, the stabilization time decreases.

There are various methods that can be used to produce high softening point pitch material. Of these, several involve solvent extraction and tend to produce mesophasic pitch precursors. Such extraction methods are: (1) super-critical extraction, (2) conventional extraction, and (3) anti-solvent extraction. These methods greatly reduce the temperature to which the pitch is subjected and remove lower-molecular weight materials, thus leaving a high-softening point, high-molecular weight fiber precursor.

Other methods can be used to produce a high softening point pitch fiber precursor. These are: (1) oxidation, either catalytic or noncatalytic, in the presence of an oxidizing gas, such as air, NO2, or SO2; (2) the reaction of pitch with sulfur; and (3) a method whereby the pitch is maintained at a temperature of about 300° C. (572° F.) while being stripped with nitrogen.

According to the present invention, there are provided improved processes for the production of enriched pitches, carbon fiber precursors, and carbon fibers or graphite fibers from petroleum pitch derived from a highly aromatic slurry oil.

Broadly, there is provided an improved process for the production of an enriched pitch from a catalytic pitch, which process comprises treating said catalytic pitch in a wiped-film evaporator system comprising a wiped-film evaporator and a means for recovering enriched pitch, the outlet of said wiped-film evaporator being connected to the inlet of said means for recovering enriched pitch and being located at a point above said inlet of said means for recovering enriched pitch so that the vertical distance between said outlet of said wiped-film evaporator and said inlet of said means for recovering enriched pitch is within the range of about 10 feet to about 40 feet and regulating the operating conditions of said wiped-film evaporator system to provide the enriched pitch.

There is provided also an improved process for the production of carbon fiber precursors which can be readily converted to carbon fibers or graphite fibers, which process comprises treating a petroleum pitch derived from a highly aromatic slurry oil in a wiped-film evaporator system comprising a wiped-film evaporator and a means for recovering enriched pitch, the outlet of said wiped-film evaporator being located above the inlet of said means for recovering enriched pitch and being connected to said inlet of said means for recovering enriched pitch by means of a sufficiently long conduit so that the vertical distance between said outlet of said wiped-film evaporator and said inlet of said means for recovering enriched pitch is within the range of about 10 feet to about 40 feet and the wiped-film evaporator system being maintained at operating conditions that will provide said enriched pitch, melting said enriched pitch to form a melted pitch, converting said melted pitch into a filament, roving, or mat of pitch fibers, and stabilizing said filament, roving, or mat of pitch fibers by contacting said filament, roving, or mat of pitch fibers with an oxidant for a time of less than 100 minutes at an elevated temperature to form a stabilized product. Typically, the enriched pitch is converted into a filament, roving, or mat of pitch fibers by use of a melt blowing apparatus as described hereinabove. Of course, a filament, roving, or mat could be obtained by melt spinning.

In either of the above instances, a positive displacement pump is a suitable means for recovering enriched pitch. An example of a positive displacement pump is a gear pump.

In addition, there is provided an improved process for the production of carbon fibers, which process comprises treating a catalytic pitch derived from a highly aromatic slurry oil in a wiped-film evaporator system comprising a wiped-film evaporator and a means for recovering enriched pitch, the outlet of said wiped-film evaporator being located above the inlet of said means for recovering enriched pitch and being connected to said inlet of said means for recovering enriched pitch by means of a sufficiently long conduit so that the vertical distance between said outlet of said wiped-film evaporator and said inlet of said means for recovering enriched pitch is within the range of about 10 feet to about 40 feet and the wiped-film evaporator system being maintained at operating conditions that will provide said enriched pitch, melting said enriched pitch to form a melted pitch, converting said melted pitch into a filament, roving, or mat of pitch fibers, stabilizing said filament, roving, or mat of pitch fibers by contacting said filament, roving, or mat of pitch fibers with an oxidant for a time of less than 100 minutes at an elevated temperature to form a stabilized product, and carbonizing said stabilized product by heating it in an inert atmosphere to a temperature within the range of about 900° C. (1,652° F.) to about 3,000° C. (5,432° F.).

The stabilized filament, roving, or mat of pitch fibers is heated in an inert atmosphere to a temperature within the range of about 900° C. (1,652° F.) to about 3,000° C. (5,432° F.) to obtain either carbon fibers or graphite fibers, depending on the conditions employed. To obtain carbon fibers, a temperature within the range of about 900° C. (1,652° F.) to about 1,500° C. (2,732° F.), preferably within the range of about 1000° C. (1,832° F.) to about 1,500° C. (2,732° F.), and more preferably within the range of about 1,000° C. (1,832° F.) to 1,200° C. (2,192° F.), is employed. In the event graphite fibers are desired, higher temperatures, such as those within the range of about 2,000° C. (3,632° F.) to about 3,000° C. (5,432° F.), preferably within the range of about 2,000° C. (3,632° F.) to about 2,500° C. (4,532° F.), must be employed in this treatment.

In these improved processes, the improvement comprises using a wiped-film evaporator system comprising a wiped-film evaporator and a means for recovering enriched pitch wherein said wiped-film evaporator is located above said means for recovering enriched pitch and the outlet of said wiped-film evaporator and the inlet of said means for recovering enriched pitch are connected by a conduit that is sufficiently long to provide a vertical distance between said outlet of said wiped-film evaporator and said inlet of said means for recovering enriched pitch that is within the range of about 10 feet to about 40 feet and regulating the operating conditions of said wiped-film evaporator system to provide said enriched pitch. Preferably, the vertical distance between the outlet of said wiped-film evaporator and the inlet of said means for recovering enriched pitch is within the range of about 20 feet to about 40 feet.

Figure 3:
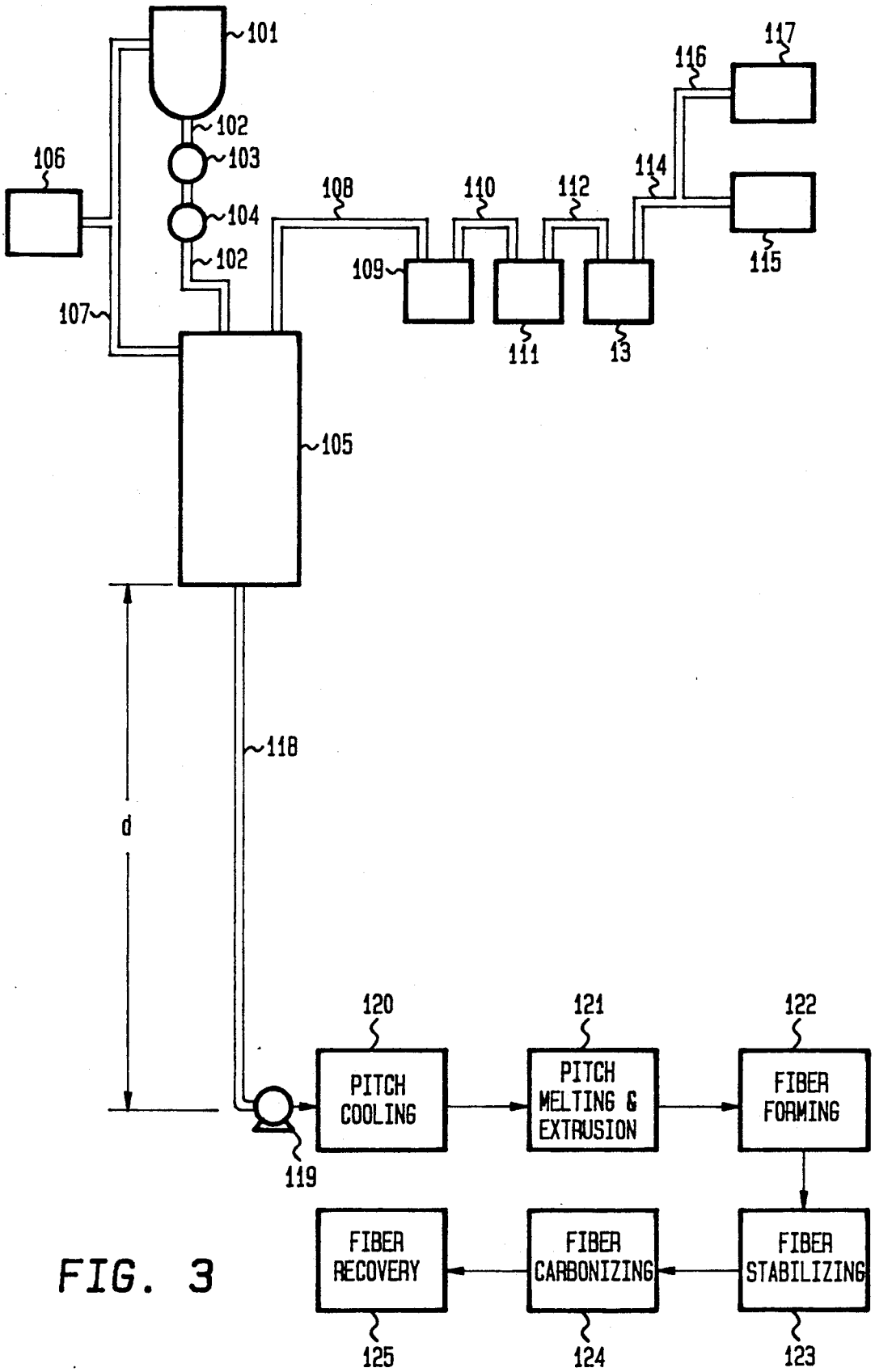
FIG. 3 is a schematic diagram of a preferred embodiment of the process of the present invention.

A preferred embodiment of the improved process of the present invention is presented in FIG. 3, which is a schematic diagram of the process. Since FIG. 3 is a simplified flow diagram of a preferred embodiment of this improved process for making carbon fibers and/or their precursors, it does not include all of the various pieces of auxiliary equipment, such as valves, heat exchangers, pumps, conveyors, and the like, which, of course, would be necessary for a complete processing scheme and which would be known and used by those skilled in the art. This example is presented for the purpose of illustration only and is not intended to limit the scope of the present invention.

Referring to FIG. 3, an A-240 pitch material is melted in melt tank 101, after the pitch material has been filtered to remove contaminants, such as catalyst fines. The pitch material is pumped through line 102 by Zenith pump 103 and through back pressure valve 104 into vertical wiped-film evaporator 105. The wiped-film evaporator 105 is heated by hot oil contained in reservoir 106. The hot oil is pumped into the wiped-film evaporator 105 from reservoir 106 by way of line 107. As the pitch material is treated in the wiped-film evaporator 105, vapors escape from the wiped-film evaporator 105 through line 108 and some of these vapors condense in first condenser 109. The remaining vapors then pass through conduit 110 into second condenser 111, where additional vapors condense. Any remaining vapors pass through conduit 112 into cold trap 113 and exit therefrom by way of conduit 114. Vacuum pump 115, which is connected to conduit 114, applies a vacuum to the system. An absolute pressure within the range of about 0.1 torr to 0.5 torr is employed. Conduit 116 connects an auxiliary vacuum pump 117 to the system, thus ensuring that a vacuum is provided in the system in the case of failure of the main vacuum pump 115.

Enriched pitch is withdrawn from wiped-film evaporator 105 via line 118 and is passed through line 118 into Zenith gear pump 119.

In the configuration of apparatus employed by the method of the present invention, the wiped-film evaporator 105 is located at a vertical distance "d" above the Zenith pump 119. The distance "d" represents the distance between the outlet of wiped-film evaporator 105 and the inlet of Zenith pump 119. This distance "d" should be within the range of about 10 feet to about 40 feet and is governed by the amount of head of enriched pitch being sent to the Zenith pump 119. In this case, the distance "d" is 20 feet.

The enriched pitch that flows from Zenith pump 119, i.e., the means for recovering enriched pitch, is cooled in zone 120 and is collected as flakes of pitch, which are comminuted and remelted in zone 121 and then sent through a melt blowing apparatus in fiber forming zone 122.

In the melt blowing apparatus, the enriched pitch is extruded through a plurality of orifices of suitable diameter in a die into a moving stream of hot inert gas. Typically, the orifices are present in the range of about 20 per inch to 30 per inch. The hot inert gas is issued from outlets surrounding or adjacent to the orifices so as to attenuate the molten material into fibers which form a fiber stream. The hot inert gas stream flows at a linear velocity parallel to and higher than the filaments issuing from the orifices so that the filaments are drawn by the gas stream.

The fibers are collected on a conveyor, as a roving or a non-woven mat, which is introduced into stabilizing zone 123. In stabilizing zone 123, the roving or mat is contacted by an oxygen-containing atmosphere. The temperature in stabilizing zone 123 is maintained close to, but at least 6° C. (11° F.) lower than, the glass transition temperature of the fibers.

Upon leaving stabilizing zone 123, the roving or mat is transported by conveyer into carbonizing zone 124, where it is contacted by an inert atmosphere, which can be nitrogen. In the carbonizing zone 124, the temperature is maintained at 1,000° C. (1,832° F.), or higher. The carbonized or graphitized fiber, roving, or mat is then recovered in fiber recovery zone 125.

As shown hereinabove, the outlet of the wiped-film evaporator is elevated a significant distance above the inlet of the pump. Preferably, the wiped-film evaporator has a vertical axis. However, a horizontal wiped-film evaporator is also contemplated.

EXAMPLE

The process of the present invention was employed to provide enriched pitches having various higher softening points. Of course, different operating conditions were needed to obtain the different enriched pitches. The process was conducted in a demonstration unit that is broadly represented by the schematic diagram presented in FIG. 3. The catalytic pitch employed in all tests was A-240 pitch obtained from Ashland Petroleum Company. The wiped-film evaporator was obtained from Pfaudler Company of Rochester, N.Y., U.S.A., and had a nominal diameter of 12⅜ inches and an evaporating surface area of 13.4 square feet. A Zenith gear pump type G-4, manufactured by Nichols-Zenith, was employed as the means for recovering the enriched pitch from the wiped film evaporator. The vertical distance between the outlet of the wiped-film evaporator and the inlet of the pump was 20 feet. Syltherm 800, obtained from Dow Chemical Company, was employed as the heat transfer medium in the wiped-film evaporator.

The pitch cooling was carried out by having the pitch exiting from the enriched pitch pump dropped onto a collector belt as solid particles or flakes, which were sent to a pitch melting and extrusion operation. The pitch melting and extrusion were carried out by crushing or comminuting the solid particles to much smaller particles, which were then transferred into an extruder obtained from Egan Machinery Company. The melted material was then passed into the fiber forming zone, a melt blowing apparatus similar to that described hereinabove.

The data obtained from the production of the enriched pitches are presented hereinbelow in Table III.

This example is presented for the purpose of illustration only and is not intended to limit unnecessarily the scope of the present invention.

TABLE III

Production of Enriched Pitches

| Enriched Pitch Softening Point | E.P.(2) Pump Rate, | WFE(1) Pressure, | Syltherm Temperature, | E.P.(2) Pump Temperature, |
|---|---|---|---|---|

TABLE III-continued

| Production of Enriched Pitches | | | | | |
|---|---|---|---|---|---|
| °C. | °F. | GPH | microns | °F. | °F. |
| 149 | 300 | 12–15 | 200–250 | 435–445 | 445–450 |
| 204 | 400 | 12–15 | 180–230 | 600–610 | 490–495 |
| 232 | 450 | 10–12 | 180–230 | 680–690 | 570–575 |
| 266 | 510 | 10–12 | 180–220 | 740–760 | 640–650 |
| 277 | 530 | 8–10 | 180–200 | 770–780 | 650–660 |

| Enriched Pitch Softening Point | | Residence Time(4) in WFE, | Residence Time(4) overall,(3) | Enriched Pitch Temperature,(5) |
|---|---|---|---|---|
| °C. | °F. | sec. | min. | °F. |
| 149 | 300 | 10–20 | 15–20 | 395–405 |
| 204 | 400 | 10–20 | 15–20 | 525–535 |
| 232 | 450 | 10–20 | 15–20 | 585–595 |
| 266 | 510 | 20–30 | 20–30 | 600–640 |
| 277 | 530 | 30–45 | 30–45 | 645–675 |

(1)WFE = wiped-film evaporator
(2)E.P. Pump = enriched pitch pump
(3)overall = Residence Time for material from inlet of WFE to outlet of E.P. Pump
(4)Residence Times are estimated and are not based on actual measurements or calculations
(5)Enriched Pitch Temperature is temperature of pitch at point between WFE outlet and E.P. Pump inlet [5 feet above pump inlet]

Please note that the temperature of the enriched pitch in the conduit connecting the outlet of the wiped-film evaporator and the inlet of the Zenith pump was measured in the conduit at a point about 5 feet above the inlet of the pump. This temperature is referred to as the "line temperature" hereinafter. The temperature of the Syltherm is referred to as the "shell temperature" hereinafter.

Broadly, in view of the above, when making enriched pitches, the operating conditions of the wiped-film evaporator system comprise a shell temperature of said wiped-film evaporator that is within the range of about 224° C. (435° F.) to about 416° C. (780° F.), an absolute pressure in said wiped-film evaporator that is within the range of about 180 microns to about 250 microns, a rate of catalytic pitch to the wiped-film evaporator that is within the range of about 8 gallons per hour to about 15 gallons per hour, a residence time of pitch in said wiped-film evaporator that is within the range of about 10 seconds to about 45 seconds, a residence time in said wiped-film evaporator system that is within the range of about 15 minutes to about 45 minutes, a temperature of said means for recovering enriched pitch that is within the range of about 230° C. (445° F.) to about 349° C. (660° F.), and a line temperature that is within the range of about 202° C. (395° F.) to about 357° C. (675° F.) to provide an enriched pitch having a softening point within the range of about 149° C. (300° F.) to about 277° C. (530° F.).

When making enriched pitches having a softening point within the range of about 149° C. (300° F.) to about 232° C. (450° F.), the operating conditions of the wiped-film evaporator system comprise a shell temperature of said wiped-film evaporator that is within the range of about 224° C. (435° F.) to about 366° C. (690° F.), an absolute pressure in said wiped-film evaporator that is within the range of about 180 microns to about 250 microns, a rate of catalytic pitch to said wiped-film evaporator within the range of about 10 gallons per hour to about 15 gallons per hour, a residence time in said wiped-film evaporator within the range of about 10 seconds to about 20 seconds, a residence time in said wiped-film evaporator system within the range of about 15 minutes to about 20 minutes, a temperature of the means for recovering enriched pitch that is within the range of about 230° C. (445° F.) to about 302° C. (575° F.), and a line temperature within the range of about 202° C. (395° F.) to about 313° C. (595° F.).

When making enriched pitches having softening points within the range of about 232° C. (450° F.) to about 277° C. (530° F.), the operating conditions of the wiped-film evaporator system comprise a shell temperature of said wiped-film evaporator that is within the range of about 360° C. (680° F.) to about 416° C. (780° F.), an absolute pressure in said wiped-film evaporator that is within the range of about 180 microns to about 230 microns, a rate of catalytic pitch to said wiped-film evaporator that is within the range of about 8 gallons per hour to about 12 gallons per hour, a residence time in said wiped-film evaporator that is within the range of about 10 seconds to about 45 seconds, a residence time in said wiped-film evaporator system that is within the range of about 15 minutes to about 45 minutes, a temperature in said means for recovering enriched pitch that is within the range of about 299° C. (570° F.) to about 349° C. (660° F.), and a line temperature that is within the range of about 307° C. (585° F.) to about 357° C. (675° F.).

The use of the elevated wiped-film evaporator system as described herein has permitted regular and continuous flow of the enriched pitch into and through the melt blowing apparatus. A process that does not use the elevated wiped-film evaporator, i.e., the process represented in FIG. 1, showed much poorer performance with regard to plugging, satisfactory fiber production, continuous operation, shot production, and the like. In fact, the system in FIG. 3, i.e., the process of the present invention, was able to stay on stream three times as long as a system similar to the process represented by FIG. 1, without the enriched pitch section of the process being the cause of shutting the unit down.

Apparently, the use of the elevated wiped-film evaporator, coupled with proper selection of operating conditions in the wiped-film evaporator system, furnishes nonmesophasic enriched pitches on a relatively continuous basis with a reduced number of plant shut-downs resulting from the malfunction and/or irregular operation of the wiped-film evaporator system. It is believed that the elevated wiped-film evaporator tends to promote a more efficient operation of the process, while proper regulation and selection of the operating conditions provide enriched pitches that are nonmesophasic in character and have the desired softening points.

Specific compositions, methods, or embodiments discussed are intended to be only illustrative of the invention disclosed by this Specification. Variation on these compositions, methods, or embodiments are readily apparent to a person of skill in the art based upon the teachings of this Specification and are therefore intended to be included as part of the inventions disclosed herein.

Reference to patents made in the Specification is intended to result in such patents being expressly incorporated herein by reference including any patents or other literature references cited within such patents.

Other modifications include pressurizing a blow case fed by the source of pitch in order to simulate the 10–40 foot preferred elevation of the source over the pitch recovery unit.

What is claimed is:

1. An improved process for the production of enriched pitch from a catalytic pitch, which process comprises treating said catalytic pitch in a wiped-film evaporator system comprising a wiped-film evaporator and a means for recovering enriched pitch, delivering said enriched pitch to the inlet of said means for recovering enriched pitch at a pressure that is equivalent to a vertical distance between the outlet of said wiped-film evaporator and the inlet of said means for recovering enriched pitch of about 10 feet to about 40 feet, and maintaining the wiped-film evaporator system at operating conditions that will provide said enriched pitch.

2. The process of claim 1, wherein said pressure equivalent to a vertical distance is equivalent to a vertical distance within the range of about 20 feet to about 40 feet.

3. The process of claim 1, wherein said means for recovering enriched pitch is a positive displacement pump.

4. The process of claim 1, wherein said catalytic pitch is a petroleum pitch that is prepared by cracking a highly aromatic slurry oil or cycle oil and said operating conditions comprise a shell temperature of said wiped-film evaporator that is within the range of about 224° C. (435° F.) to about 416° C. (780° F.), a residence time of pitch in said wiped-film evaporator that is within the range of about 10 seconds to about 45 seconds, a residence time in said wiped-film evaporator system that is within the range of about 15 minutes to about 45 minutes, a temperature of said means for recovering enriched pitch that is within the range of about 230° C. (445° F.) to about 349° C. (660° F.), and a line temperature that is within the range of about 202° C. (395° F.) to about 357° C. (675° F.) to provide an enriched pitch having a softening point within the range of about 149° C. (300° F.) to about 277° C. (530° F.).

5. The process of claim 1, wherein said catalytic pitch is a petroleum pitch that is prepared by cracking a highly aromatic slurry oil or cycle oil and said operating conditions comprise a shell temperature of said wiped-film evaporator that is within the range of about 224° C. (435° F.) to about 366° C. (690° F.), a residence time in said wiped-film evaporator that is within the range of about 10 seconds to about 20 seconds, a residence time in said wiped-film evaporator system that is within the range of about 15 minutes to about 20 minutes, a temperature of the means for recovering enriched pitch that is within the range of about 230° C. (445° F.) to about 302° C. (575° F.), and a line temperature that is within the range of about 202° C. (395° F.) to about 313° C. (595° F.) to provide an enriched pitch having a softening point within the range of about 149° C. (300° F.) to about 232° C. (450° F.).

6. The process of claim 1, wherein said catalytic pitch is a petroleum pitch that is prepared by cracking a highly aromatic slurry oil or cycle oil and said operating conditions comprise a shell temperature of said wiped-film evaporator that is within the range of about 360° C. (680° F.) to about 416° C. (780° F.), a residence time in said wiped-film evaporator that is within the range of about 10 seconds to about 45 seconds, a residence time in said wiped-film evaporator system that is within the range of about 15 minutes to about 45 minutes, a temperature in said means for recovering enriched pitch that is within the range of about 299° C. (570° F.) to about 349° C. (660° F.), and a line temperature that is within the range of about 307° C. (585° F.) to about 357° C. (675° F.) to provide an enriched pitch having a softening point within the range of about 232° C. (450° F.) to about 277° C. (530° F.).

7. The process of claim 3, wherein said catalytic pitch is a petroleum pitch that is prepared by cracking a highly aromatic slurry oil or cycle oil and said operating conditions comprise a shell temperature of said wiped-film evaporator that is within the range of about 224° C. (435° F.) to about 416° C. (780° F.), a residence time of pitch in said wiped-film evaporator that is within the range of about 10 seconds to about 45 seconds, a residence time in said wiped-film evaporator system that is within the range of about 15 minutes to about 45 minutes, a temperature of said means for recovering enriched pitch that is within the range of about 230° C. (445° F.) to about 349° C. (660° F.), and a line temperature that is within the range of about 202° C. (395° F.) to about 357° C. (675° F.) to provide an enriched pitch having a softening point within the range of about 149° C. (300° F.) to about 277° C. (530° F.).

8. The process of claim 7, wherein said positive displacement pump is a gear pump.

9. The process of claim 8, wherein said pressure equivalent to a vertical distance is equivalent to a vertical distance within the range of about 20 feet to about 40 feet.

10. In an improved process for the production of enriched pitch from a catalytic pitch that is prepared by cracking a highly aromatic slurry oil or cycle oil wherein said catalytic pitch is treated in a wiped-film evaporator system, the improvement which comprises using a wiped-film evaporator system comprising a wiped-film evaporator and a means for recovering enriched pitch wherein said wiped-film evaporator is located above said means for recovering enriched pitch and the outlet of said wiped-film evaporator and the inlet of said means for recovering enriched pitch are so located as to deliver said enriched pitch at a pressure equivalent to a vertical distance between said outlet of said wiped-film evaporator and said inlet for said means for recovering enriched pitch that is within the range of about 10 feet to about 40 feet and regulating the operating conditions of said wiped-film evaporator system to provide said enriched pitch.

11. The process of claim 10, wherein said pressure equivalent to a vertical distance is equivalent to a vertical distance within the range of about 20 feet to about 40 feet.

12. The process of claim 10, wherein said operating conditions of said wiped-film evaporator system comprise a shell temperature of said wiped-film evaporator that is within the range of about 224° C. (435° F.) to about 416° C. (780° F.), a residence time of pitch in said wiped-film evaporator that is within the range of about 10 seconds to about 45 seconds, a residence time in said wiped-film evaporator system that is within the range of about 15 minutes to about 45 minutes, a temperature of said means for recovering enriched pitch that is within the range of about 230° C. (445° F.) to about 349° C. (660° F.), and a line temperature that is within the range of about 202° C. (395° F.) to about 357° C. (675° F.) to provide an enriched pitch having a softening point within the range of about 149° C. (300° F.) to about 277° C. (530° F.).

13. The process of claim 12, wherein said pressure equivalent to a vertical distance is equivalent to a vertical distance within the range of about 20 feet to about 40 feet.

14. An improved process for the production of carbon fiber precursors which can be readily converted to carbon fibers to graphite fibers, which process comprises treating a catalytic pitch that is prepared by cracking a highly aromatic slurry oil or cycle oil in a wiped-film evaporator system comprising a wiped-film evaporator and a means for recovering enriched pitch, delivering enriched pitch to the inlet of said means for recovering enriched pitch at a pressure that is equivalent to a vertical distance between the outlet of said wiped-film evaporator and the inlet of said means for recovering enriched pitch of about 10 feet to about 40 feet, and maintaining the wiped-film evaporator system at operating conditions that will provide enriched pitch, melting said enriched pitch to form a melted pitch, converting said melted pitch into a filament, roving, or mat of pitch fibers, and stabilizing said filament, roving, or mat of pitch fibers by contacting said filament, roving, or mat of pitch fibers with an oxidant for a time of less than 100 minutes at an elevated temperature to form a stabilized product.

15. The process of claim 14, wherein said pressure equivalent to a vertical distance is equivalent to a vertical distance within the range of about 20 feet to about 40 feet.

16. The process of claim 14, wherein said operating conditions comprise a shell temperature of said wiped-film evaporator that is within the range of about 360° C. (680° F.) to about 416° C. (780° F.), a residence time in said wiped-film evaporator that is within the range of about 10 seconds to about 45 seconds, a residence time in said wiped-film evaporator system that is within the range of about 15 minutes to about 45 minutes, a temperature in said means for recovering enriched pitch that is within the range of about 299° C. (570° F.) to about 349° C. (660° F.), and a line temperature that is within the range of about 307° C. (585° F.) to about 357° C. (675° F.) to provide an enriched pitch having a softening point within the range of about 232° C. (450° F.) to about 277° C. (530° F.).

17. The process of claim 14, wherein said operating conditions comprise a shell temperature of said wiped-film evaporator that is within the range of about 393° C. (740° F.) to about 416° C. (780° F.), a residence time in said wiped-film evaporator that is within the range of about 20 seconds to about 45 seconds, a residence time in said wiped-film evaporator system that is within the range of about 20 minutes to about 45 minutes, a temperature in said means for recovering enriched pitch that is within the range of about 338° C. (640° F.) to about 349° C. (660° F.), and a line temperature that is within the range of about 316° C. (600° F.) to about 357° C. (675° F.) to provide an enriched pitch having a softening point within the range of about 266° C. (510° F.) to about 277° C. (530° F.).

18. The process of claim 16, wherein said pressure equivalent to a vertical distance is equivalent to a vertical distance within the range of about 20 feet to about 40 feet.

19. The process of claim 17, wherein said pressure equivalent to a vertical distance is equivalent to a vertical distance within the range of about 20 feet to about 40 feet.

20. The process of claim 17, wherein said oxidant comprises air.

21. In an improved process for the production of carbon fiber precursors which can be readily converted to carbon fibers or graphite fibers, wherein a catalytic pitch that is prepared by cracking a highly aromatic slurry oil or cycle oil is treated in a wiped-film evaporator system to provide enriched pitch, said enriched pitch is melted to form a melted pitch, said melted pitch is converted into a filament, roving, or mat of pitch fibers, and said filament, roving, or mat of pitch fibers is stabilized by contacting said filament, roving, or mat of pitch fibers with an oxidant for a time of less than 100 minutes at an elevated temperature, the improvement which comprises using a wiped-film evaporator system comprising a wiped-film evaporator and a means for recovering enriched pitch wherein said wiped-film evaporator is located above said means for recovering enriched pitch and the outlet of said wiped-film evaporator and the inlet of said means for recovering enriched pitch are located so as to deliver said enriched pitch to said inlet at a pressure equivalent to a vertical distance between said outlet of said wiped-film evaporator and said inlet of said means for recovering enriched pitch that is within the range of about 10 feet to about 40 feet and regulating the operating conditions of said wiped-film evaporator system to provide said isotropic enriched pitch.

22. The process of claim 21, wherein said pressure equivalent to a vertical distance is equivalent to a vertical distance within the range of about 20 feet to about 40 feet.

23. The process of claim 21, wherein said operating conditions comprise a shell temperature of said wiped-film evaporator that is within the range of about 360° C. (680° F.) to about 415° C. (780° F.), a residence time in said wiped-film evaporator that is within the range of about 10 seconds to about 45 seconds, a residence time in said wiped-film evaporator system that is within the range of about 15 minutes to about 45 minutes, a temperature in said means for recovering enriched pitch that is within the range of about 299° C. (570° F.) to about 349° C. (660° F.), and a line temperature that is within the range of about 307° C. (585° F.) to about 357° C. (675° F.) to provide an enriched pitch having a softening point within the range of about 232° C. (450° F.) to about 277° C. (530° F.).

24. The process of claim 21, wherein said operating conditions comprise a shell of said wiped-film evaporator that is within the range of about 393° C. (740° F.) to about 416° C. (780° F.), a residence time in said wiped-film evaporator that is within the range of about 20 seconds to about 45 seconds, a residence time in said wiped-film evaporator system that is within the range of about 20 minutes to about 45 minutes, a temperature in said means for recovering enriched pitch that is within the range of about 338° C. (640° F.) to about 349° C. (660° F.), and a line temperature that is within the range of about 316° C. (600° F.) to about 357° C. (675° F.) to provide an enriched pitch having a softening point within the range of about 266° C. (510° F.) to about 277° C. (530° F.).

25. The process of claim 23, wherein said pressure equivalent to a vertical distance is equivalent to a vertical distance within the range of about 20 feet to about 40 feet.

26. The process of claim 24, wherein said pressure equivalent to a vertical distance is equivalent to a vertical address within the range of about 20 feet to about 40 feet.

27. A process according to claim 1 in which said vertical distance is simulated by pressurizing said means by recovering enriched pitch by applying fluid pressure and wherein said means for recovering enriched pitch is geometrically located at a point over, below, or on a level with, said evaporator.

28. In an improved process for the production of enriched pitch from a catalytic pitch, which process comprises treating said catalytic pitch in a wiped-film evaporator system comprising a wiped-film evaporator and a means for recovering enriched pitch comprising a gear pump, the improvement which comprises:

A. locating the outlet of said wiped-film evaporator with respect to the inlet of said means for recovering enriched pitch and connecting said outlet to said inlet by means of a sufficiently long conduit so as to provide a pressure at said inlet that is equivalent to a vertical distance within the range of about 20 feet to about 40 feet;

B. employing Syltherm, its derivatives, or its homologues as heat transfer medium in said wiped-film evaporator; and C. maintaining said wiped-film evaporator system at operating conditions that will provide said enriched pitch, said operating conditions comprising a shell temperature of said wiped-film evaporator that is within the range of about 360° C. (680° F.) to about 416° C. (780° F.), a residence time in said wiped-film evaporator that is within the range of about 10 seconds to about 45 seconds, a residence time in said wiped-film evaporator system that is within the range of about 15 minutes to about 45 minutes, a temperature in said means for recovering enriched pitch that is within the range of about 299° C. (570° F.) to about 349° C. (660° F.), and a line temperature that is within the range of about 307° C. (585° F.) to about 357° C. (675° F.) to provide an enriched pitch having a softening point within the range of about 232° C. (450° F.) to about 277° C. (530° F.).

29. In an improved process for the production of carbon fiber precursors which can be readily converted to carbon fibers to graphite fibers, which process comprises treating a catalytic pitch that is prepared by thermally cracking a substantially paraffin-free, highly-aromatic slurry oil or cycle oil in a wiped-film evaporator system comprising a wiped-film evaporator and a means for recovering enriched pitch comprising a gear pump to produce an enriched pitch, converting said enriched pitch into a filament, roving, or mat of pitch fibers, and stabilizing said filament, roving, or mat of pitch fibers by contacting said filament, roving, or mat of pitch fibers with an oxidant at an elevated temperature to form a stabilized product, the improvement which comprises:

A. locating the outlet of said wiped-film evaporator above the inlet of said means for recovering enriched pitch and connecting said outlet to said inlet by means of a sufficiently long conduit so as to provide a pressure at said inlet that is equivalent to a vertical distance within the range of about 20 feet to about 40 feet;

B. employing Syltherm, its derivatives, or its homologues as a heat transfer medium in said wiped-film evaporator; and C. maintaining said wiped-film evaporator system at operating conditions that will provide enriched pitch, said operating conditions comprising a shell temperature of said wiped-film evaporator that is within the range of about 360° C. (680° F.) to about 416° C. (780° F.), a residence time in said wiped-film evaporator that is within the range of about 10 seconds to about 45 seconds, a residence time in said wiped-film evaporator system that is within the range of about 15 minutes to about 45 minutes, a temperature in said means for recovering enriched pitch that is within the range of about 299° C. (570° F.) to about 349° C. (660° F.), and a line temperature that is within the range of about 307° C. (585° F.) to about 357° C. (675° F.) to provide an enriched pitch having a softening point within the range of about 232° C. (450° F.) to about 277° C. (530° F.).

* * * * *